US006919850B2

(12) United States Patent
Kennedy et al.

(10) Patent No.: US 6,919,850 B2
(45) Date of Patent: Jul. 19, 2005

(54) BODY WORN ANTENNA

(75) Inventors: Neil T. Kennedy, Miramar, FL (US); James T. Wiggenhorn, Coral Springs, FL (US)

(73) Assignee: Motorola Inc., Schaumburg, IL (US)

( * ) Notice: Subject to any disclaimer, the term of this patent is extended or adjusted under 35 U.S.C. 154(b) by 4 days.

(21) Appl. No.: 10/424,398

(22) Filed: Apr. 28, 2003

(65) Prior Publication Data

US 2004/0212540 A1 Oct. 28, 2004

(51) Int. Cl.[7] ..... H01Q 1/12

(52) U.S. Cl. ..... 343/718; 343/700 MS

(58) Field of Search ..... 343/700 MS, 718, 343/893

(56) References Cited

U.S. PATENT DOCUMENTS

| | | | | | |
|---|---|---|---|---|---|
| 4,694,694 | A | * | 9/1987 | Vlakancic et al. | 73/386 |
| 5,148,002 | A | * | 9/1992 | Kuo et al. | 219/211 |
| 5,600,331 | A | * | 2/1997 | Buralli | 343/700 MS |
| 5,905,466 | A | * | 5/1999 | Jha | 343/700 MS |
| 6,013,007 | A | * | 1/2000 | Root et al. | 482/8 |
| 6,594,370 | B1 | * | 7/2003 | Anderson | 381/315 |
| 2002/0093787 | A1 | * | 7/2002 | Ito et al. | 361/683 |

* cited by examiner

*Primary Examiner*—Shih-Chao Chen
(74) *Attorney, Agent, or Firm*—Barbara R. Doutre

(57) ABSTRACT

An antenna array (200) having a number of patch antennas (202, 204, 206, 208) forming a circumferential radius is provided. The antenna array (200) is integrated within a body worn device (500) such as a belt, coat, or harness (210). Location tracking technology is used in conjunction with the antenna array (200) to select the optimal antenna from the array.

23 Claims, 3 Drawing Sheets

BODY WORN ANTENNA

TECHNICAL FIELD

This invention relates in general to antennas, and more particularly to antennas used in conjunction with location tracking technology.

BACKGROUND

A variety of antenna form factors are used in communication devices. A popular form factor used in today's two-way radios is the omni-directional antenna. FIG. 1 shows a two-way radio 102 having an omni-directional antenna 104 as known in the prior art. In the typical two-way radio configuration, the radio with an omni-directional antenna is used several inches away from an operator's body. Performance problems can arise, however, when such a radio is held within close proximity to the individual operator. Given an omni-directional antenna, a 10 to 20 dB loss in power output can be expected which degrades the range of the radio. Thus, a radio having an omni-directional antenna is limited as to the amount of coverage it can provide when the radio is worn on or held close to the body.

In today's public safety environments, there is a desire to track public safety personnel and their activities with respect to each other with as little user intervention as possible. An individual involved in a public emergency scene may not have the time, ability, or knowledge to relay location information to others. While location tracking technology can be implemented within the two-way radio environment, the overall performance issues associated with the omni-directional antenna are still present. If a radio is being held within a holster strapped to the user's side, then the omni-directional antenna will not provide its maximum coverage capability, making the tracking of an individual more difficult.

Accordingly, there is a need for an antenna that provides improved performance over the omni-directional antenna in order to facilitate the ability to track individuals.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 2:
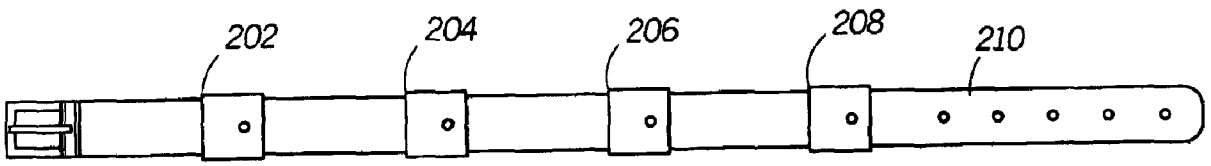
FIG. 2 is an antenna system formed in accordance with a first embodiment of the invention.

While the specification concludes with claims defining the features of the invention that are regarded as novel, it is believed that the invention will be better understood from a consideration of the following description in conjunction with the drawing figures, in which like reference numerals are carried forward.

In accordance with the present invention, there is provided herein an antenna system that forms a substantially circumferential radius to provide 360 degrees of radiation coverage about a user. To provide 360 degrees (°) of coverage, the antenna system of the present invention incorporates a plurality of antennas (N) evenly spaced around a user with each antenna preferably operating within a mutually exclusive bandwidth. In accordance with the present invention, the plurality of patch antennas are coupled to or integrated within a garment to be worn by a user. The garment can take on a variety of form factors such as a belt, coat, jacket, vest, harness, hat, or other user worn apparatus.

Referring now to FIG. 2, there is shown an antenna system 200 formed in accordance with a first embodiment of the invention. Antenna system 200 includes four patch antennas 202, 204, 206, and 208 coupled to a substrate 210, with each antenna being located substantially 90 degrees apart (360°/4). The substrate in this embodiment comprises a belt. When worn by a user, each patch antenna provides a radiation pattern that is substantially unidirectional (90 °, 3 dB bandwidth). When integrated as part of a garment, the garment effectively operates as the substrate for the antenna system of the present invention. Again, the ability to provide sufficient radiation coverage is achieved by forming a circumferential radius using the patch antennas.

Figure 3:
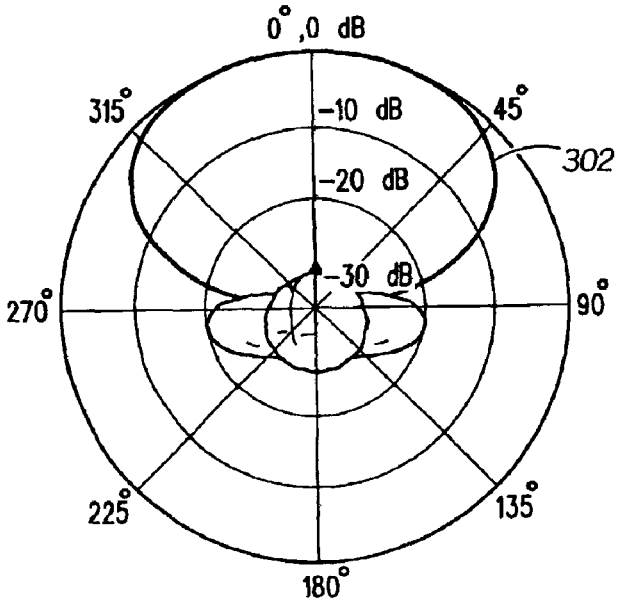
FIG. 3 shows a simulation of a radiation pattern that approximates the radio frequency radiation from one of the patch antennas of FIG. 2.

FIG. 3 shows a simulation of a radiation pattern 302 that approximates the radio frequency (RF) radiation from one of the patch antennas of FIG. 2 in accordance with the first embodiment. The antenna radiation is approximated as having a 90 degree bandwidth (BW), in this case from 315° to 45°. The usefulness of radiation pattern 302 is that only a small portion of the pattern is coincident with the operator thus providing optimum coverage.

Figure 4:
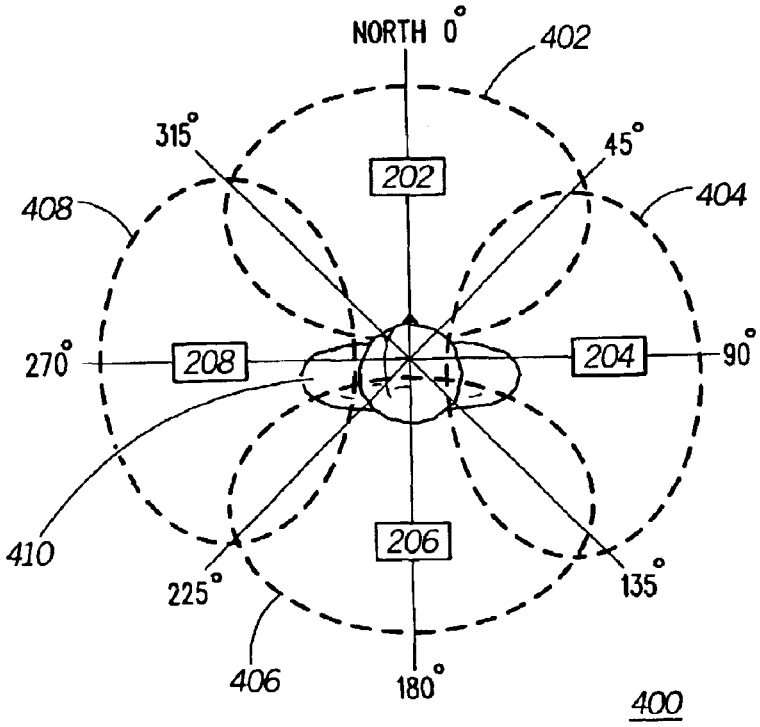
FIG. 4 shows a simulation of relative radiation patterns of an antenna system having four antennas in accordance with a preferred embodiment of the invention.

FIG. 4 shows a simulation of relative radiation patterns 400 provided by each of the antennas of antenna system 200 of the first embodiment. FIG. 4 shows the preferred location for each of the four antennas 202, 204, 206, 208 relative to an operator 410 and the relative radiation pattern 402, 404, 406, 408 associated with each antenna. When used within a communication system to be described below, the operator 410 can transmit to someone due east of him, with a heading of 0 degrees, and antenna 204, with radiation pattern 404 having a BW 45° to 135°, will be used.

Figure 5:
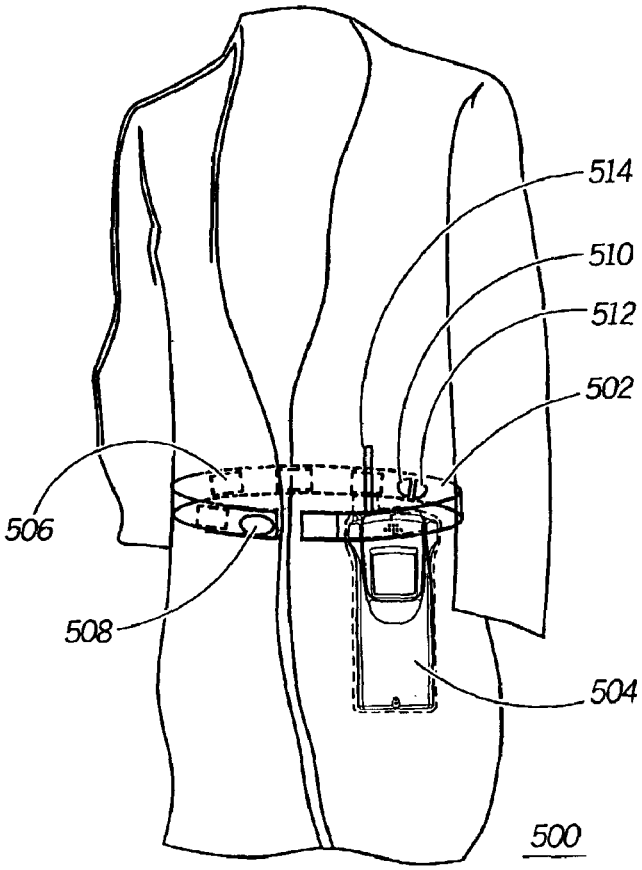
FIG. 5 shows a garment having an antenna system formed in accordance with the present invention integrated therein.

FIG. 5 shows a user worn apparatus 500 having an antenna system 502 that includes N patch antennas 506 spaced 360°/N apart around its circumference thereby forming an antenna array in accordance with the present invention. The user worn apparatus 500 in this second embodiment consists of a coat within which is integrated the antenna system 502 operatively coupled to a radio 504. The radio 504 is capable of switching between an omni-directional antenna 514 and the antenna system 502 of the present invention using well known technology such as a pin diode switch (not shown). The antenna system 502 and radio 504 preferably include location tracking technology so that a user wearing apparatus 500 can be tracked in a communication system having both open and closed environments.

In accordance with the second embodiment, the user worn apparatus 500 further includes an electronic compass 508 shown here integrated within the antenna system 502 to facilitate location tracking of the individual wearing the coat. The compass 508 becomes referenced perpendicular to a user's abdomen when the coat is worn. The compass 508 provides a bearing for the user, the bearing being used to select an antenna within the antenna system 502. In accordance with the second embodiment of the invention, a particular antenna is selected from the plurality of antennas as the result of an operator's relative compass heading to another. Also included within the user worn apparatus 500 are an altimeter 510 and a pedometer 512, shown here as integrated within the antenna system 502. The altimeter and pedometer 510, 512 are used in conjunction with the bearing information to provide a user's coordinates so that the user can be tracked in both open and closed environments.

Figure 6:
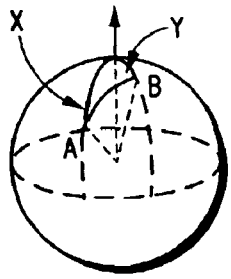
FIG. 6 shows a spherical coordinate system that can be used by a communication system operating in accordance with the present invention.

The following Spherical Triangle Equations (see FIG. 6) known in the art are used to determine the bearing:

$X$=Bearing from $A$ to $B$(°)

$Y$=Bearing from $B$ to $A$(°)

$D$=Great Circle Distance from $A$ to $B$(°)

Point A: Latitude=LatA, longitude=LonA

Point B: Latitude=LatB, Longitude=LonB

Conditions: LatB>LatA, and LonA<LonB 1 step on pedometer=1 meter (m)

Re=Radius of the earth 6378.14 km

Arc length=$(D)(\pi)(Re)/180$ $C$=Lon$A$−Lon$B$ $A$Minus$B$=arctan((sin(0.5(*Lat$B$Lat$A$))/(cos(0.5*(Lat$B$+Lat$A$))))*cot(0.5*$C$))

$A$Plus$B$=arctan((cos(0.5(*Lat$B$−Lat$A$))/(sin(0.5*(Lat$B$+Lat$A$))))*cot(0.5*$C$))

$X$=180−($A$Plus$B$+$A$Minus$B$)(°)

$Y$=180+$X$(° from North)

$D$=2*arctan(tan(0.5*(Lat$B$−Lat$A$))*sin($A$Plus$B$)sin($A$Minu$B$))(°)

$Dm$=60(nmi/°)*1852(m/nmi)*$D$(°); (m)

Figure 7:
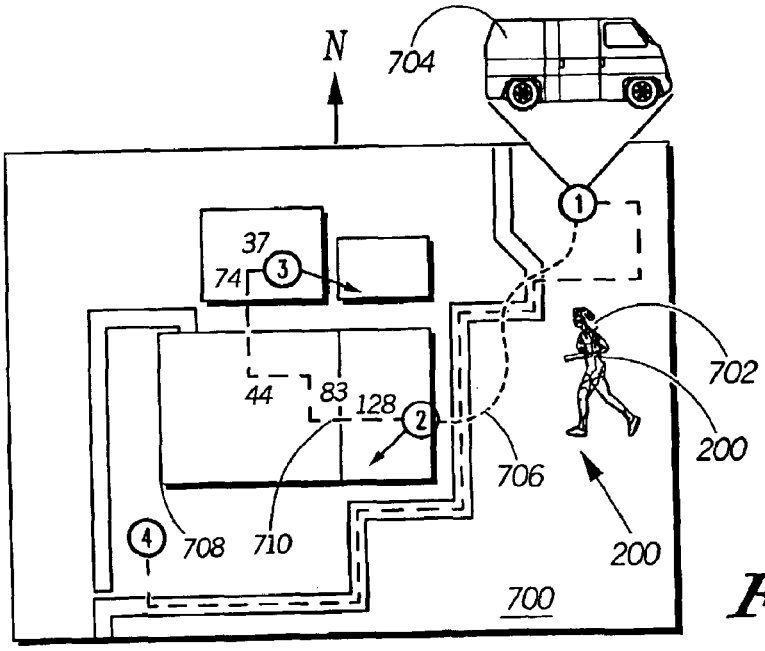
FIG. 7 shows an example of a mapped area for a communication system operating in accordance with the present invention.

FIG. 7 shows an example of a mapped area for a communication system 700 having location tracking technology operating in accordance with a preferred embodiment of the invention. Within communication system 700, two radio operators, a user 702 and partner 704 are communicating. User 702 is outfitted with a radio having an antenna system formed in accordance with the present invention and worn about the user's body. In this example, the antenna system utilizes an antenna array such as that described in FIG. 2 having four antennas 202, 204, 206, 208 spaced evenly about the user with first antenna 202 worn in front of the user as shown in FIG. 4. The antenna system further includes location tracking devices such as the pedometer 510, altimeter 512, and compass 508 that were described in FIG. 5 and used in conjunction with radio 504. The radio 504 also includes location tracking technology for selecting an antenna from the antenna array.

In the communication system 700, the bearing is calculated based on a user and partner's coordinates. These coordinates are communicated to the system and are used to determine how many degrees from North where the partner 704 is located. Since each antenna 202, 204, 206, 208 has a mutually exclusive bandwidth in which it is used, the compass heading and the bearing to the partner 704 are compared, and the antenna with coverage in the area of the bearing is selected. The communication system 700 incorporates two different subsystems that allow a user to maintain coverage in both open (outside) and closed (urban building) environments. For open environments both the user 702 and his partner 705 transmit their GPS coordinates at pre-determined intervals, for example as data packets.

For closed environments, in which the GPS coverage is unavailable, the radio 504 records data from the pedometer 510, altimeter 512, and compass 508 to form an array of coordinates that are added back to the last user GPS location before the signal was lost to create a new set of coordinates. The system then performs the calculation to obtain a bearing to the partner 704 and selects an antenna with a bandwidth that coincides with the determined bearing. Since GPS coordinates are used in the calculation of bearing, there are no restrictions on the movements of the radio operators. Also, the partner 704 can utilize GPS coordinates for the user, and employ other methods to increase the likelihood of a good communications path by performing the same calculation as the user to find an opposite bearing. For example, the partner can utilize a directional Yagi type antenna to constantly track the operator.

The usefulness of the communication system of the present invention can be demonstrated within a variety of changing environments—open, closed, and changing therebetween. For example, the system can track a user moving about in an open environment using GPS technology to determine coordinates. The user can also be tracked as he moves from an open to a closed environment through the use dead reckoning to create a new set of coordinates. The system also provides tracking capability as one individual changes location while another individual remains in a closed environment.

Referring again to FIG. 7, four points (1–4) illustrate the locations of the two radio operators, user 702 and partner 704. Points 2 and 3 show the heading of the user 702. In accordance with the preferred embodiment of the invention, a particular antenna is selected as the result of the user's relative compass heading to his partner 704. For this example the user 702 leaves his partner 704 at a location 1 (Lat: 26.1470862° N, Lon: 80.252536° W) and proceeds to location 2 following the dotted path 706 to make the first communication. Since both the user 702 and the partner 704 are in an open environment, their GPS coordinates are exchanged and used to find a bearing.

The bearing from point 2 to 1 is 20.94°. The user 702 is facing 222° or SW so the antenna that has bandwidth coincident with that bearing is antenna 206 of FIG. 4. The partner 704 has a bearing to the user of 200.94° and the distance between them is 267.13 m.

Bearings: User($X$)=20.94°, Partner($Y$)=200.94°, $Dm$=267.12 m

User at point 2, facing 222°
Antenna 202 @ 222.0°, bandwidth 177.0° to 267.0°
Antenna 204 @ 312.0°, bandwidth 267.0° to 357.0°
Antenna 206 @ 42.0°, bandwidth 357.0° to 87.0°
Antenna 208 @ 312.0°, bandwidth 87.0° to 177.0°
Thus, Antenna choice # 206, 357.0°<20.94°<87.0°

The user 702 then moves inside a building 708 following the dashed line 710 and looses GPS coverage. The system then reverts to dead reckoning utilizing the compass 508 and pedometer 510. As the user 702 moves through the building 710 each step is recorded by the pedometer 510 along with the compass heading and his altitude. Referring to the map 700, the user has traveled 128 steps, W; 83 steps, N; 44 steps, W; 74 steps, N; and 37 steps, E. The Table below shows an example of the array of data captured using dead reckoning.

TABLE

Dead Reckoning

| Steps | Compass Heading | Altitude |
|---|---|---|
| 128 | 270 | 0 |
| 83 | 0 | 0 |
| 44 | 270 | 0 |
| 74 | 0 | 0 |
| 37 | 90 | 0 |

Each of the data points is combined into vectors North and West, converted into degrees, and added back to the last GPS coordinate.

Thus,

Total distance West=128 m+44 m−37 m=135 m

Total distance North=83 m+74 m=157 m

Distance West in degrees=0.135 km*180°/(6378.14 km*π)= 0.001213° W

Distance North in degrees=0.157 km*180°/(6378.14 km*π)= 0.001410° N

New coordinate point 3 latitude=Lat2+ΔLat=26.144841°+ 0.001410°=26.146251° N New coordinate point 3 longitude=Lon2+ΔLon=80.253493°+ 0.0012130=0.254706° N These dead reckoning calculations thus show a total of 135 m West (0.001213° W) and 157 m North (0.001410° N). Adding this dead reckoning data to point 2's GPS coordinates results in the determination of the location of point 3. For this communication the partner 704 is still located at point 1, with the user now at point 3 facing 118°. The bearing calculated from point 3 to point 1 is 66.79°. Since, the user is facing 118° or SE, the antenna that has bandwidth coincident with that bearing is number 208. The partner has a bearing to the user of 246.79° and the distance between them is 235.51 m.

Bearings: User(*X*)=66.79°, Partner(*Y*)=246.79°, *Dm*=235.51 m

Antenna 202 @ 118.0°, bandwidth 73.0° to 163.0°
Antenna 204 @ 208.0°, bandwidth 163.0° to 253.0°
Antenna 206 @ 298.0°, bandwidth 253.0° to 343.0°
Antenna 208 @ 28.0°, bandwidth 343.0° to 73.0°
Thus, Antenna choice # 208, 343.0°<66.79°<73.0°

Finally, the user 702 maintains his location and heading at point 3, but the partner 704 moves to the SW of the building to point 4. The bearing calculated from point 3 to 4 is 199.75°. The partner 704 has a bearing to the user of 19.75° and the distance between them is 385.49 m. The user 702 is still facing 118° or SE and thus the antenna that has bandwidth coincident with that bearing is antenna 204.

Bearings: Partner(*X*)=19.75°, User(*Y*)=199.75°, *Dm*=385.49 m

User at point 3, facing 118°
Antenna 202 @ 118.0°, bandwidth 73.0° to 163.0°
Antenna 204 @ 208.0°, bandwidth 163.0° to 253.0°
Antenna 206 @ 298.0°, bandwidth 253.0° to 343.0°
Antenna 208 @ 28.0°, bandwidth 343.0° to 73.0°
Thus, Antenna choice # 204, 163.0°<199.75°<253.0°

The communication system 700 of the present invention is not limited to a pair of users, but extends to unlimited users transmitting back to a repeater in which each person employs location tracking. The use of a location tracking technology, such as described by the present invention, to determine which antenna within the array to select during transmit eliminates the need for certain setup requirements, such as triangulation techniques with fixed antennas.

Accordingly, there has been provided an antenna system comprising a garment containing N patch antennas spaced 360°/N apart around its circumference. The user-worn garment can take on a variety of form factors. As mentioned previously, the antenna system of the present invention forms an antenna array when worn about a user's body. The user can be a human being, an animal, or a device. So, for example, the antenna system can be mounted to a dog or robot type device as well as to a person.

When used within a communication system having location tracking technology, automatic selection of an antenna within the antenna array is achieved as a result of the location tracking technology. The communication system can be configured as described above to provide coverage in open, or both open and closed environments through the use of various location tracking devices. Public safety personnel, such a police, fire, and rescue personnel can all benefit from the improved coverage and accurate location determination provided by the antenna system of the present invention. In addition to determining the bearing for the transmit path, the user and his colleague(s) can now know exactly where the other is located. In situations such as a smoke filled building this can be especially useful.

Figure 1:
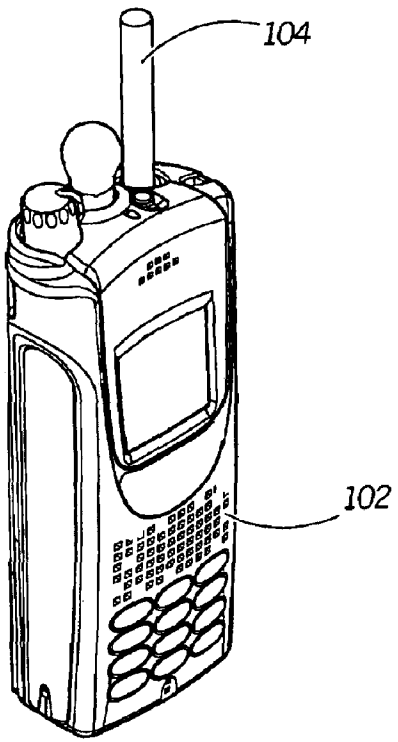
(PRIOR ART) FIG. 1
FIG. 1 is a prior art two-way radio having an omni-directional antenna.

Accordingly, there has been provided an antenna system that overcomes the disadvantages associated with prior art body worn omni-directional antennas. The antenna system of the present invention provides greater gain than the body worn omni-directional antenna shown in FIG. 1 and thus an improvement in power output is achieved.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna system comprising a plurality of patch antennas forming a circumferential radius wherein each of the plurality of patch antennas operates with a mutually exclusive bandwidth selectively activated to provide 360 degree radiation coverage.

2. The antenna system of claim 1, wherein the patch antennas are formed within a garment.

3. An antenna system comprising a user worn apparatus containing N patch antennas spaced 360°/N apart around its circumference, N being a positive natural number, and wherein catch of N patch antennas operates with a mutually exclusive bandwidth selectively activated to provide 360 degree radiation coverage.

4. The antenna system of claim 3, wherein the user-worn apparatus comprises a garment.

5. The antenna system of claim 4, wherein the garment comprises a belt.

6. The antenna system of claim 4, wherein the garment comprises a coat.

7. The antenna system of claim 4, wherein the garment comprises a harness.

8. The antenna system of claim 3, further comprising an electronic compass integrated within the user worn apparatus.

9. The antenna system of claim 8, wherein the electronic compass is integrated into the user worn apparatus so as to align perpendicular to a user's abdomen.

10. The antenna system of claim 8, further comprising an altimeter.

11. The antenna system of claim 8, further comprising a pedometer.

12. An antenna system comprising a plurality of patch antennas forming a circumferential radius integrated into a body worn device selectively activated to provide 360 degree radiation coverage.

13. A radio including an antenna array forming a circumferential radius worn around a user's body selectively activated to provide 360 degree radiation coverage.

14. A The radio of claim 13, further comprising location cracking technology for selecting an antenna from the antenna array.

15. The radio of claim 13, wherein the antenna array further comprises a compass.

16. The radio of claim 13, further comprising an altimeter.

17. The radio of claim 13, Further comprising a pedometer.

18. A communication system, comprising:

location tracking technology;

a radio; and an antenna array formed of patch antennas operatively coupled to the radio, the antenna array forming a circumferential radius about a user's body, each patch antenna providing a mutually exclusive bandwidth to selectively provide 360 degree radiation coverage.

19. The communication system of claim 18, further comprising a compass coupled to the antenna array.

20. The communication system of claim 19, wherein the compass provides a bearing, the bearing being used to select an antenna within the antenna array having an appropriate bandwidth.

21. The communication system of claim 19, wherein the antenna array provides radio coverage in both open and closed environments.

22. A communication system, including:

location tracking technology;

a radio operable with the location tracking technology; and an antenna array operatively coupled to the radio, the antenna array including a plurality of patch antennas forming a circumferential radius, an antenna from the plurality of patch antennas being automatically selected as a result of the location tracking technology to selectively provide 360 degree radiation coverage.

23. The communication system of claim 22, wherein the antenna array is integrated within a body worn device.

* * * * *